US007451759B2

(12) United States Patent
Weiss et al.

(10) Patent No.: US 7,451,759 B2
(45) Date of Patent: Nov. 18, 2008

(54) WIRELESS FIREPLACE DAMPER CONTROL DEVICE

(75) Inventors: Cory A. Weiss, Warren, MI (US); Kurt A. Dykema, Holland, MI (US); David L. Klamer, Zeeland, MI (US)

(73) Assignee: Flue Sentinel, LLC, Shelby Township, MI (US)

( * ) Notice: Subject to any disclaimer, the term of this patent is extended or adjusted under 35 U.S.C. 154(b) by 445 days.

(21) Appl. No.: 11/120,334

(22) Filed: May 3, 2005

(65) Prior Publication Data

US 2005/0247303 A1 Nov. 10, 2005

Related U.S. Application Data

(60) Provisional application No. 60/567,923, filed on May 4, 2004.

(51) Int. Cl.
*F24C 3/00* (2006.01)

(52) U.S. Cl. ..... 126/286; 126/39 R; 126/58; 126/85 R; 126/39 D; 126/84

(58) Field of Classification Search ..... 126/39 R, 126/58, 85 R, 286, 1, 39 D, 84, 536
See application file for complete search history.

(56) References Cited

U.S. PATENT DOCUMENTS

| | | | |
|---|---|---|---|
| 2,996,064 | A | 8/1961 | Haas |
| 3,273,625 | A | 9/1966 | Holtzman et al. |
| 3,831,582 | A | 8/1974 | Mahoney |
| 4,087,045 | A | 5/1978 | Matthews |
| 4,131,413 | A | 12/1978 | Ryno |
| 4,175,695 | A | 11/1979 | Cresswell |
| 4,204,833 | A | 5/1980 | Kmetz et al. |
| 4,254,759 | A | 3/1981 | Schmidt |
| RE30,936 | E | 5/1982 | Kmetz et al. |
| RE31,256 | E | 5/1983 | Schmidt |
| 4,406,396 | A | 9/1983 | Habegger |
| 4,416,611 | A | 11/1983 | Zivny |
| 4,550,874 | A | 11/1985 | Clouser et al. |
| 4,570,847 | A | 2/1986 | Clouser |
| 4,649,808 | A | 3/1987 | Ward et al. |

(Continued)

*Primary Examiner*—Steven B. McAllister
*Assistant Examiner*—Nikhil Mashruwala
(74) *Attorney, Agent, or Firm*—Robert K. Roth; Miller, Canfield Paddock & Stone

(57) ABSTRACT

A wireless damper control device comprises a damper positioned in a flue, movable between a closed position where the flue is blocked and an open position, a damper controller which sends a damper signal which moves the damper between the open position and the closed position, and a fire side controller which transmits a fireplace signal to open a gas valve to initiate combustion when a fire is desired at a fireplace, and to close the gas valve to terminate combustion when a fire is no longer desired at the fireplace, and which receives a damper status signal from the damper controller indicating whether the damper is in the closed position or the open position. When a fire is desired at the fireplace, the fire side controller transmits a damper control signal to move the damper to the open position, and the fireside controller transmits the fireplace signal to open the gas valve after receiving the damper status signal indicating that the damper is in the open position, and the fire side controller is wirelessly connected to the flue side controller.

18 Claims, 5 Drawing Sheets

U.S. PATENT DOCUMENTS 4,846,400 A 7/1989 Crouse
4,880,376 A 11/1989 Bartels et al.
4,924,564 A 5/1990 Shah
4,928,668 A 5/1990 Reusch, Sr.
4,949,705 A 8/1990 Smith
4,962,750 A 10/1990 Bridgewater
5,056,500 A 10/1991 Evens
5,292,063 A 3/1994 Klaus
5,393,221 A 2/1995 McNally
5,450,841 A * 9/1995 Whitaker et al. ..... 126/512
5,503,550 A 4/1996 DePalma
5,555,876 A 9/1996 Francisco, Jr. et al.
5,575,274 A 11/1996 DePalma
5,609,522 A * 3/1997 Szwartz ..... 454/7
5,654,813 A 8/1997 Whitworth
5,983,890 A 11/1999 Thomas et al.
6,074,200 A 6/2000 Bowman et al.
6,139,311 A 10/2000 Bowman et al.
6,213,117 B1 4/2001 Kirk et al.
6,257,871 B1 7/2001 Weiss et al.
6,378,516 B1 4/2002 Blount
6,413,079 B1 7/2002 Lyons et al.
6,439,877 B1 8/2002 Weiss
6,644,957 B2 11/2003 Weiss
6,915,799 B2 * 7/2005 Weiss ..... 126/536
2003/0170578 A1 9/2003 Weiss
2004/0115578 A1 6/2004 Weiss

* cited by examiner

WIRELESS FIREPLACE DAMPER CONTROL DEVICE

RELATED APPLICATION

This application claims priority benefit of U.S. provisional patent application No. 60/567,923 filed on May 4, 2004.

FIELD OF THE INVENTION

This invention relates to a device for controlling a damper, and more particularly to dampers which are controlled remotely.

BACKGROUND OF THE INVENTION

Many homes today have fireplaces where a flue in a chimney connects the outside air to the fireplace. Such a connection can result in leakage of cold air into the home. A damper can be positioned in the flue and used to keep the cold air out. The damper is movable between a closed position which prevents air from leaking into or out of the home, to an open position which allows air to flow and exhaust products of combustion to flow out of the home. Such known dampers are controlled by a chain, handle, lever or the like. An operator has to remember to open the damper prior to starting a fire in the fireplace, or else the products of combustion would become trapped in the home.

The products of wood fireplaces can include soot and smoke. Soot and smoke are visible, and if a wood fireplace had a damper which was closed, it would become immediately apparent that the damper was closed upon combustion of the wood. However, the products of incomplete gas combustion can be invisible and toxic ($CO_2$, CO, for example). Because of this potentially hazardous situation, ventilation of air has been required for gas fireplaces where dampers have been used. That is, the damper had to be permanently blocked open. Further, in many places dampers were not allowed to be used in combination with gas fireplaces.

U.S. Patent Publication 2004/0115578 to Weiss discloses a new and improved damper control device for outside applications, particularly gas fireplaces, which prevents air from entering or exiting a home and which is also safe and reliable. However, this device uses running wires from the damper near the top of a chimney to a power source inside the home. It would be desirable to eliminate the wires needed to connect to the top of the chimney.

SUMMARY OF THE INVENTION

In accordance with a first aspect, wireless damper control device comprises a damper positioned in a flue, wherein the damper is movable between a closed position where the flue is blocked and an open position, a damper controller which transmits a damper signal which moves the damper between the open position and the closed position, and a fire side controller which transmits a fireplace signal to open a gas valve to initiate combustion when a fire is desired at a fireplace, and to close the gas valve to terminate combustion when a fire is no longer desired at the fireplace, and which receives a damper status signal from the damper controller indicating whether the damper is in the closed position or the open position. When a fire is desired at the fireplace, the fire side controller sends the fireplace signal to open the gas valve after receiving the damper status signal indicating that the damper is in the open position, and the fire side controller is wirelessly connected to the flue side controller. A transceiver may be incorporated at both the fire side controller and at the damper controller, allowing wireless communication by radio waves.

From the foregoing disclosure and the following more detailed description of various preferred embodiments it will be apparent to those skilled in the art that the present invention provides a significant advance in the technology and art of damper control devices. Particularly significant in this regard is the potential the invention affords for providing a high quality damper control device for fireplaces and other outside or remote applications without the use of wires connecting the damper control device to the rest of the assembly. Additional features and advantages of various preferred embodiments will be better understood in view of the detailed description provided below.

Figure 1:
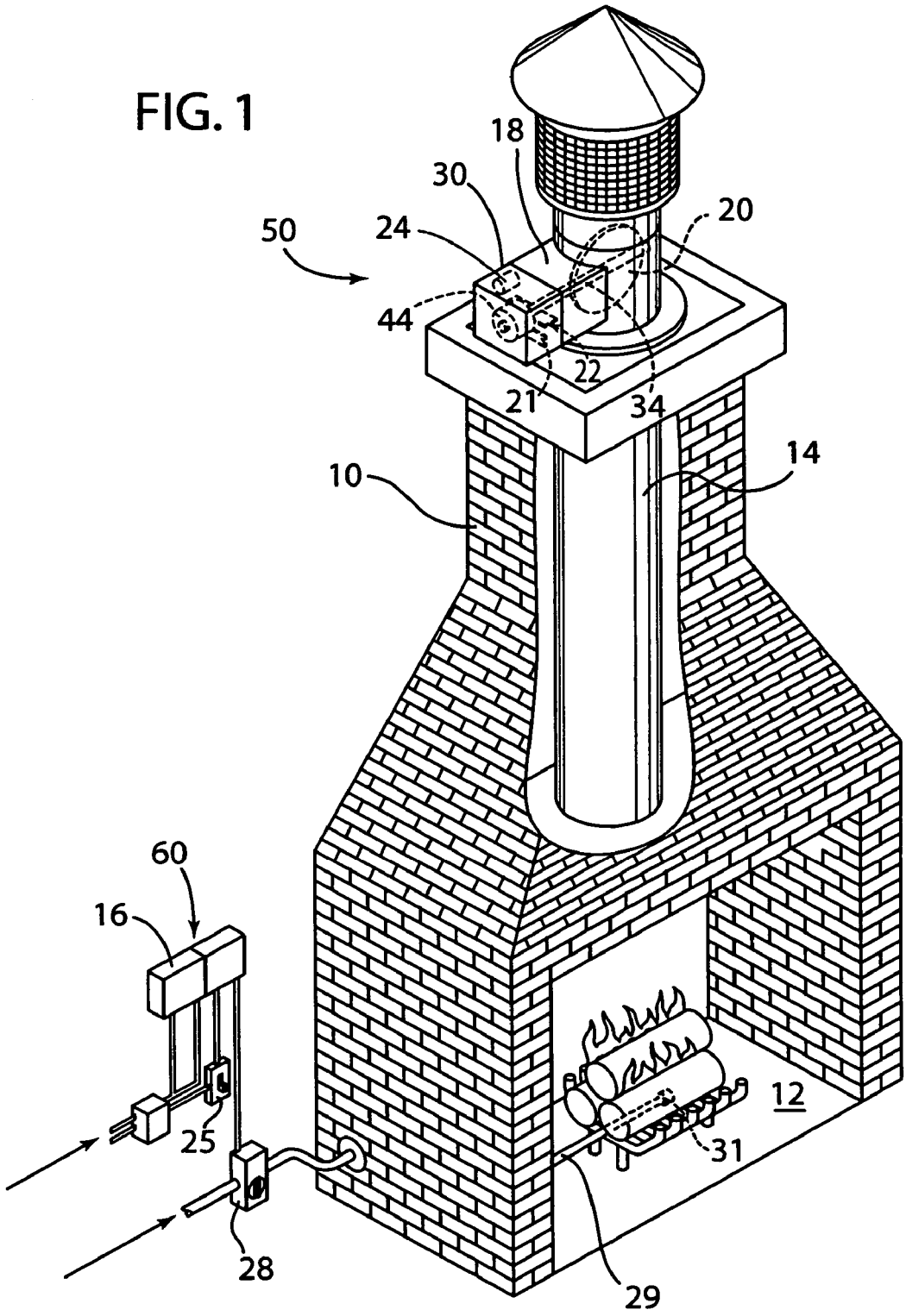
FIG. 1 is a perspective schematic view illustrating a chimney incorporating a wireless control device in accordance with a preferred embodiment.

It should be understood that the appended drawings are not necessarily to scale, presenting a somewhat simplified representation of various preferred features illustrative of the basic principles of the invention. The specific design features of the damper control device as disclosed here will be determined in part by the particular intended application and use environment. Certain features of the illustrated embodiments have been enlarged or distorted relative to others to facilitate visualization and clear understanding. In particular, thin features may be thickened, for example, for clarity of illustration. All references to direction and position, unless otherwise indicated, refer to the orientation illustrated in the drawings.

DETAILED DESCRIPTION OF CERTAIN PREFERRED EMBODIMENTS

It will be apparent to those skilled in the art, that is, to those who have knowledge or experience in this area of technology, that many uses and design variations are possible for the damper control device disclosed here. The following detailed discussion of various alternative and preferred features and embodiments will illustrate the general principles of the invention with reference to a wireless damper control device for a gas fireplace. Other embodiments suitable for other applications, such as wood burning fireplaces, will be apparent to those skilled in the art given the benefit of this disclosure.

Turning now to the drawings, FIG. 1 shows a chimney 10 having a fireplace 12, a flue 14 which receives products of combustion from the fireplace and a damper 20. In the preferred embodiment shown here, the fireplace 12 is a gas fireplace, with the gas supplied by a gas line 29 to igniter 31. The damper 20 is movable by motor 44 through rotatable shaft 34 (at least partially enclosed by a box 18 and shroud 30) between a closed position where it prevents outside air from flowing down and leaking into a house, to an open position (as shown in FIG. 1) where the products of combustion from a fire can escape to the outside.

A damper controller 50 is positioned near the damper 20, preferably at least partially within a box 30 to shield it from the elements. A fire side controller 60 is positioned generally adjacent the fireplace, although may be located in such a way as to not interfere with aesthetic considerations of the fireplace. Several control devices may be used to turn the fireplace on and off. For example, an on/off switch 25 initiates the sequence of operation which results in a fire at the fireplace. A diagnostic display or status module 16 may be incorporated into the fire side controller.

Figure 2:
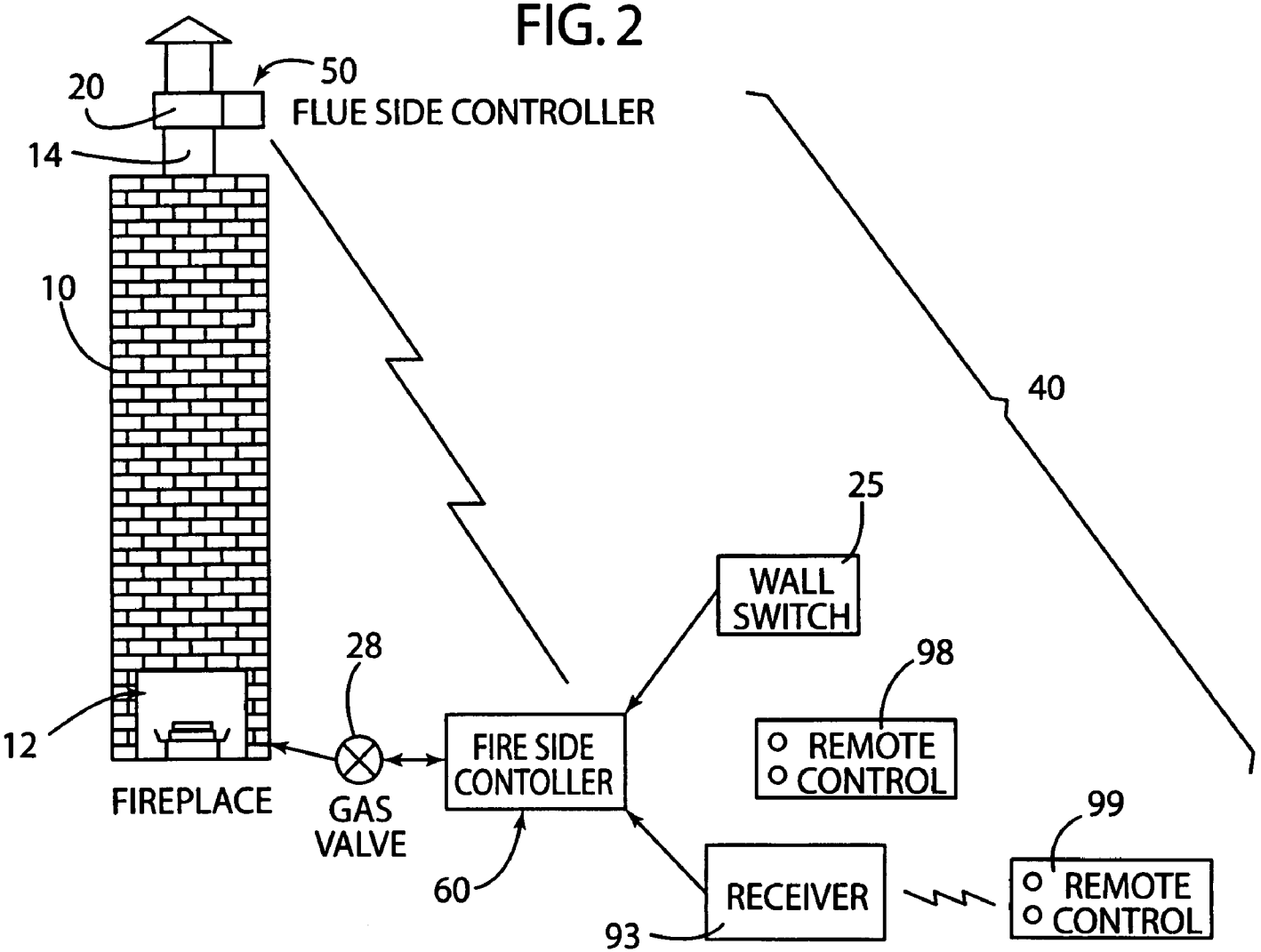
FIG. 2 is a simplified schematic of a control circuit for a damper control device in accordance with a preferred embodiment which has a fire side controller and a flue side controller.

A control circuit 40 comprises the damper controller 50 and the fire side controller 60 and comprises one or more printed circuit boards. FIG. 2 shows how the controllers are arranged with respect to one another and with respect to the fireplace and flue. In accordance with a highly advantageous feature, there is a wireless connection between the damper controller and the fire side controller, most preferably a wireless two-way radio (RF) signal. This would allow the damper to be installed without having to run electrical wires back to the fireplace. It would also allow the damper to work with lower voltage systems. The damper controller is shown having a battery 24 supplying voltage to a power supply 26. The power supply provides consistent power to the damper controller. The fire side controller 60 may also be provided with a battery or an electrical outlet which could provide 24V AC to a power supply 64 which provides consistent power to PIC microcontroller 62. An on/off switch can be positioned as a wall mounted switch 25, or incorporated into a handheld wireless or remote device (either conventional off the shelf 99 or as part of an original manufacturer supplied remote control 98), or both. An RF signal from remote 98 may be received by a receiver 93.

Figure 3:
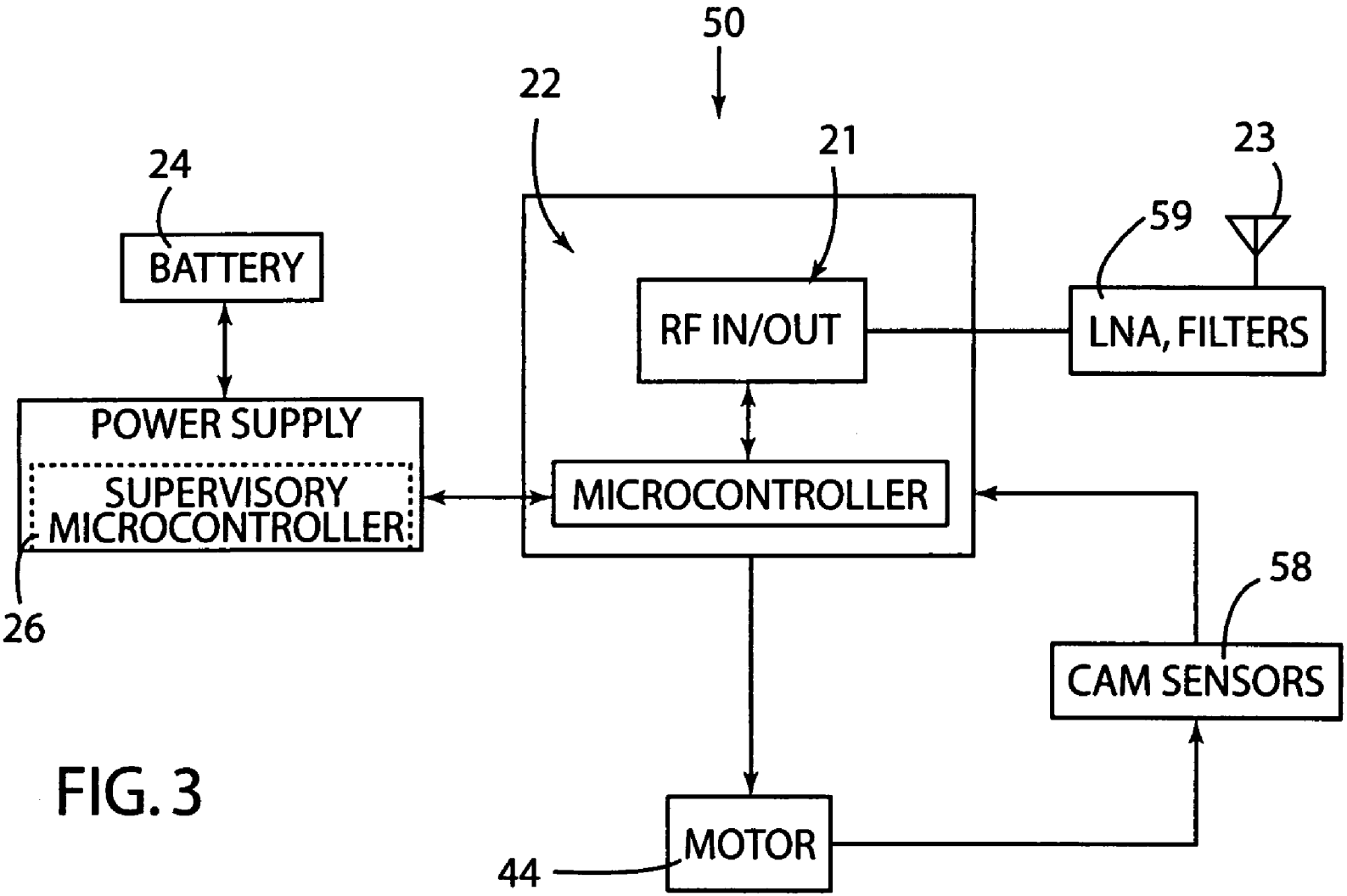
FIG. 3 shows a block diagram of the flue side controller.

FIG. 3 shows a schematic focusing on the damper controller 50, showing how the various elements of the damper controller electrically interrelate with one another. An antenna circuit board 23 and a damper control circuit board 22 are shown. The damper control board has a transceiver 21 which receives an RF signal (such as a signal to move the damper to the open position) through low noise amplifiers and other filters 59, and may be constructed, for example as a Z-wave, all systems integrated circuit (ASIC) with supporting circuitry. The antenna circuit board 23 and damper control circuit board 22 may be combined into one circuit board or separated into a pair of circuit boards, as shown. The motor 44 rotates the output shaft 34 and damper 20 (shown best in FIG. 5). Limit switches serve as cam sensors 58 and are connected to a cam that is slaved with the damper 20 to engage the switches as the damper moves between the open and closed positions. In this way rotation of the damper motor 44 provides feedback to the damper controller 50 to indicate the position of the damper 20. The battery 24 is provided to supply power to the circuit boards and to the motor. A small supervisory microcontroller can control the power supply and provide timing. The motor can take power directly from the battery. The rest of the damper controller may be provided with a controlled 3 Volts. As this battery is mounted up near the top of the chimney, it is preferable that the battery have a very long life. An example of a battery which has suitable power, voltage and durability characteristics is a 3.6 V D Cell battery made by Tadiran of Israel.

Figure 5:
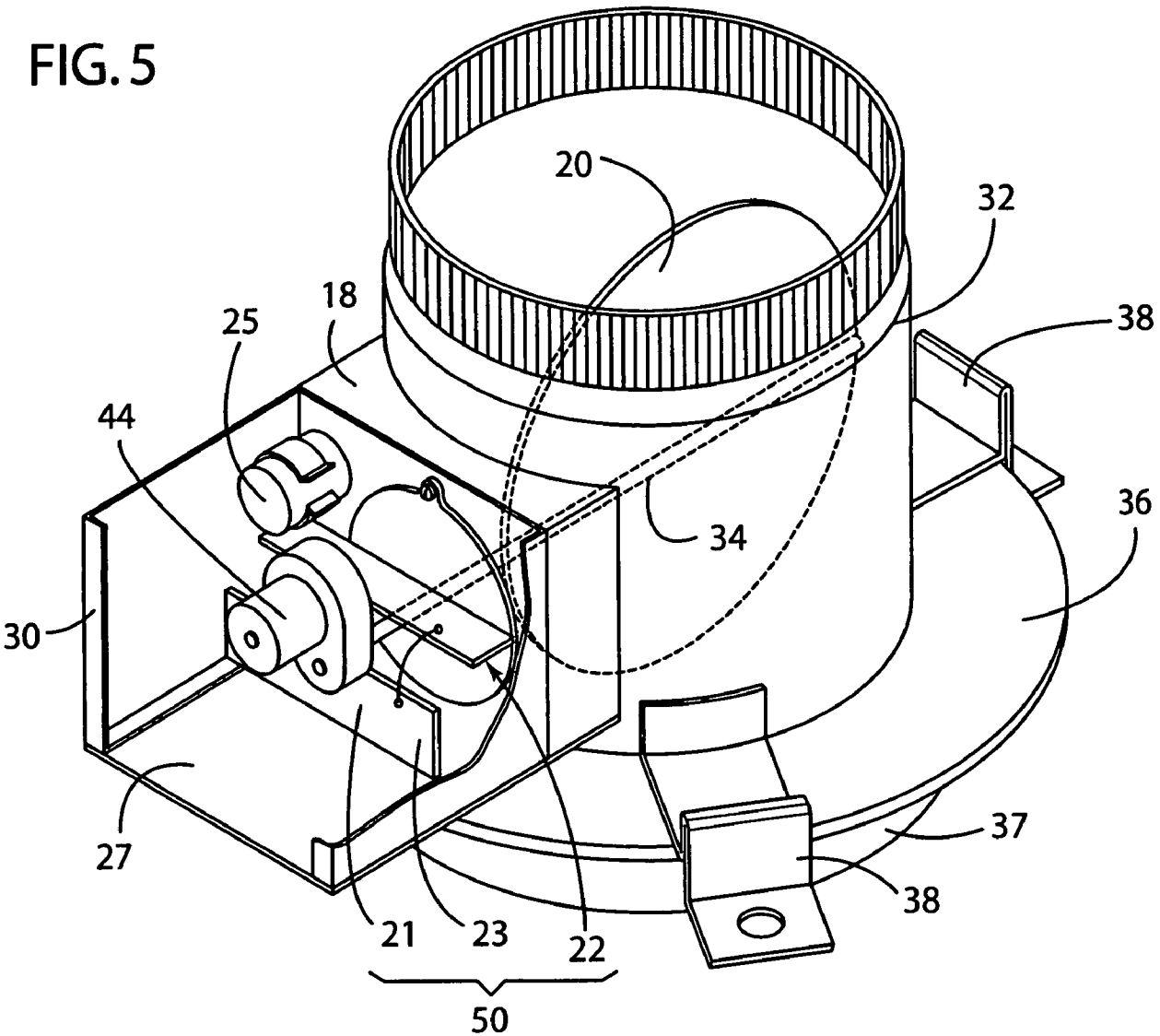
FIG. 5 is a perspective view of a damper and the flue side controller.

Turning now to the damper 20 installation in the flue 14, FIG. 5 shows the damper 20 positioned in a damper pipe 32, drive motor 44 and accompanying damper controller 50 positioned in a preferably weatherproof damper control box 30. A portion of the box 30 is removed for illustrative purposes. To rotate the damper between open and closed positions, a rotatable shaft 34 operatively connects the drive motor and the damper. As the flue can get quite hot during operation of the fireplace, the rotatable shaft serves to space the drive motor and electronic controls away from the flue and damper pipe 32. Also, shaft 34 is preferably at least partially enclosed by shroud 18 to protect the shaft from weathering, dirt, etc. A portion 37 of the damper pipe 32 may extend beyond a mounting member 36, shown in FIG. 5 as a ring-like structure. The portion 37 is adapted to fit inside the flue 14, and mounting brackets 38 are adapted to receive bolts that would fit into the chimney, thereby securing the damper 20 and damper pipe 32 to the chimney. The flue 14, damper pipe 32, and any adapter pipes as well as the shroud 30 and box 18 may optionally be constructed from sheet metal, except for the bottom 27 of the box, which may be formed from a suitable plastic to allow for reception at the antenna circuit board 23. The chimney 10 may be made of bricks. In such embodiments, the flue may also be formed as a separate tube or merely as a passageway in the bricks.

Figure 4:
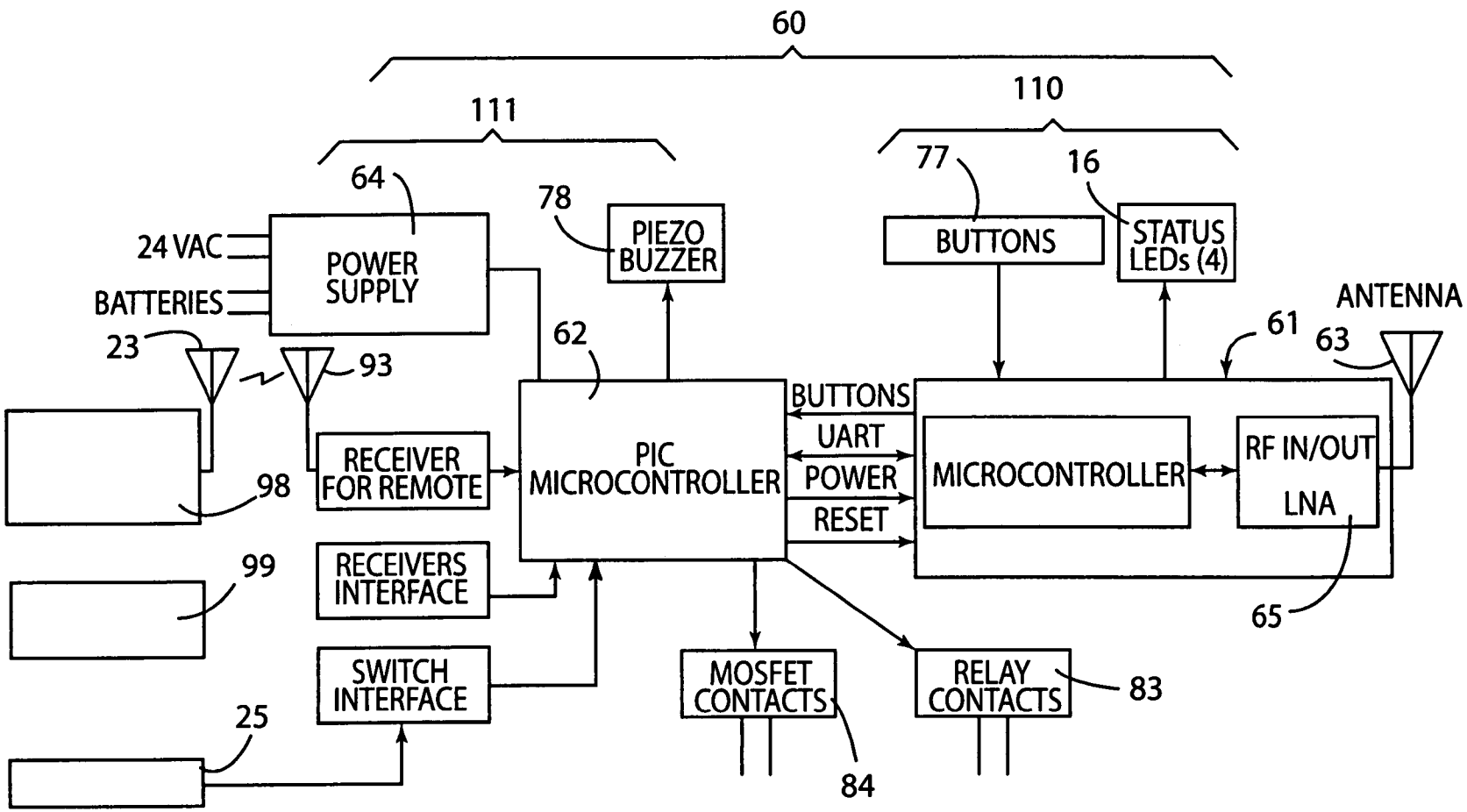
FIG. 4 shows a block diagram of the fire side controller.

The fire side controller 60 is shown schematically in FIG. 4, showing how various elements are electrically connected to one another. Controller 60 can comprise an antenna circuit board 61 and a PIC microcontroller circuit board 62, for example, Z-Wave ASICs with supporting circuitry. The microcontroller circuit board is preferably designed to interpret signals received from the transceiver, monitor the service switches 77 and wall switch 25, and to control any relays and any buzzer 78. The circuit boards can be stacked one on top of the other if desired, and preferably fit into a box that can be mounted in a wall. As shown, top 111 and bottom 110 circuit boards are used, with the top including the antenna circuit board 61 and the bottom circuit board including the microcontroller circuit board. Relay contacts 83 or Mosfet contacts 84 may be connected to the microcontroller circuit board 62. Relay contacts 83 would control gas valve 28. (An open relay would mean fire off, and a closed relay would mean fire on). Such relays 83 would be used if the system is powered with 24 volts. If the fire side controller 60 has a battery as its power supply 64, then the relay contacts are not connected to the gas valve. Mosfet contacts 84 are preferably used with a battery as the power source, as they help conserve battery power.

The antenna circuit board 61 comprises a transceiver which can transmit instructions to the damper controller (in the form of an RF damper control signal) and receive information corresponding to the status of the damper. A status module 16 may be connected to the controller to indicate the status of various elements. Preferably the pair of printed circuit boards 61, 62 are electrically connected in series with the gas valve control and diagnostic devices or status module 16. The fire side controller 60 communicates with the damper controller 50 via transceiver 65 which can use RF (or other suitable wireless transmission including, for example, ultrasound) and operates the fireplace appliance in the same manner as if the damper was directly electrically connected via wires. The fire side controller is designed to be compatible with either 24 VAC or millivolt systems. Thus the power supply 64 may be a battery, a power supply from the home (as shown in FIG. 4). As these batteries are readily accessible and typically not subjected to the environmental extremes of battery 24, it is not required to provide a battery having an unusually long life. As noted above, a specially developed remote control 98 may be wirelessly connected to the fire side controller, received by receiver 93. A third party device 98 may require a separate interface for processing to reach the microcontroller. Either remote 98, 99 may be limited to On/Off capabilities only. Preferably the transceivers 21, 65 and the receiver 93 operate on different frequencies.

Once the control circuit 40 is installed into the fireplace and flue, the transceivers 21, 65 can monitor each others RF signals. These signals would preferably comprise encrypted messages using variable codes to prevent improper operation and use spread spectrum or frequency-hopping to mitigate interference. Representative signals include a damper status signal generated by the damper controller, a damper signal generated by the damper controller, a damper control signal transmitted from the fire side controller to the damper controller, and a fireplace signal generated by the fire side controller. For example, during normal operation, in response to a request (from switch 25, or one of the remotes 98, 99) to turn on the fireplace, the fire side controller transmits a fireplace signal to the damper controller. In response, the damper controller sends a damper signal to move the damper to the open position. Once that is complete, the damper controller transmits a damper status signal indicating the damper is in the open position, and this signal is received by the fire side controller. Only when the damper status signal indicates that the damper is in the open position is the fireplace signal generated. The fireplace signal opens the gas valve (typically by energizing a solenoid), and allows gas to flow to the igniter 31. Prior to this, however, the damper 20 is sent a damper control signal to move to the open position. Through the use of the limit switches, the damper sends a damper signal indicating whether the damper is in the open position or closed position. Only when the damper signal indicates that the damper is in the open position is the fireplace signal sent.

Advantageously the control circuit may use intermittent confidence tones (an RF signal) to ensure that the fireplace only operates when it is safe to do so. This "handshake" may be done infrequently to conserve power. For example the handshake (transmission of a request for a damper status signal) may be made between the damper controller and fire side controller once every thirty seconds while the damper is in the open position. If the confidence tone is lost, (i.e. a damper status signal is received that indicates something other than the damper in the open position), then the fire side controller will shut off power to the gas valve and thereby eliminate the fire at the fireplace. (It will be understood here that the terms eliminate or terminate refer to cutting off the flow of gas at a gas fireplace. However, gas for a pilot light may remain.) The transceivers 21, 65 used herein may work under any of several RF protocols, including, for example, FCC Paragraph 15.247 and Z-wave. A built-in time-delay for returning the damper to the closed position at a predetermined time after the fireplace fire is extinguished may also be used.

As shown in FIG. 4, optionally the fire side controller may be provided with a status module 16 which provides information about the status of the damper 20 the fireplace gas valves 28 and igniter 31 when in a diagnostic mode. This module would consist of lights indicating the condition of the damper for either operational or troubleshooting purposes. For example, these conditions can comprise: whether the overall system has power, whether the damper is open (as indicated by a damper status signal), and whether the fireplace signal has been sent, etc. In the preferred embodiment shown in FIG. 4, four indicator lights or LEDs would respond to a signal indicating several different conditions. For example, after switching to a diagnostic mode (by, for example, holding one of a series of buttons 77 in a diagnostic position for an extended period of time), a first LED can indicate the type of power used—a blinking light for a battery, a solid light for a 24 V power source. A second LED is used to indicate the status of the damper—a blinking light for hold open mode, a solid light for moving the damper to the closing position (and the light off for closed). A third LED blinks to indicate the period of time between the call for flames and the fireplace signal is sent and can show a solid light when the fire is on. A fourth LED, when blinking, can indicate a bad RF link. That is, one or the other transceivers are malfunctioning or inoperative, or there is interference or the transceivers are out of their operating range. When the fourth LED is on, the damper is in the open position. When the fourth LED is off, the damper is in the closed position.

The series of buttons 77 may also preferably comprise a service switch to hold the damper in the open position in the event of intermittent operation. This allows the fireplace to be used while waiting for service. While in diagnostic mode, the service switch may be held for a short period of time, for example, 2 seconds to enter this 'hold open' mode. Preferably only one button is used to enter into the diagnostic mode and the hold open mode. As a further option, the status module may also be connected to the control circuit so as to indicate a response from a sensor signal from a sensor which senses a pollutant such as, for example, carbon dioxide or carbon monoxide levels, or heat in the house. A sensor as described here could be particularly useful with wood burning applications. When such pollutant reaches a predetermined criteria the control circuit 40 would send a call to the damper controller to send a damper signal to move the damper 20 to the open position and to indicate this on the status module. Such an indication or alarm can be a light or an audible sound, for example.

The control circuit may also have a "ping" mode useful for RF evaluation. In the ping mode, the fire side controller sends repeated signals to the damper side transceiver for a limited period of time, for example, 30 seconds. These repeated ping signals cause the damper side controller to stay awake for an extended period of time, instead of turning off immediately as it would during the cycle of normal operation. If no response is received from the damper side transceiver, then a warning indication may be made, such a sound generated by buzzer 78. If a response is heard (a signal is sent back to the fire side transceiver) then a different sound such as a pair of beeps may be generated by the buzzer. The damper controller would remain on for another period of time (for example, 30 seconds) and then return to normal operation. To enter and exit the ping mode, one of the buttons 77 may be pressed for a short time while not in diagnostic mode. The buzzer 78 may sound briefly to indicate transition to and from the ping mode. Also, while in ping mode all four LEDs may be on continuously. Other combinations of features suitable for display at the status indicator 16 will be readily apparent to those skilled in the art given the benefit of this disclosure.

In addition to the normal operation, diagnostic mode, hold open mode and ping mode discussed above, the control circuit may also go into sleep mode or deep sleep mode. These sleep modes allow the control circuit to only function intermittently, thereby reducing power demands. This is particularly advantageous when, as may be the case, power is supplied by a battery. Sleep mode is the time between intermittent transmissions (or handshakes) made to check the damper status. Deep sleep mode occurs in response to inactivity for a predetermined extended period of time. For example, if the fireplace has not been used for at least 7 consecutive days, the period of time between handshakes may extended to 60 seconds. Other modes of operation will be readily apparent to those skilled in the art given the benefit of this disclosure.

In accordance with a highly advantageous feature, the fire side controller 60 and the damper controller 50 may each be provided with a remote ID. This remote ID can be established through an initial startup process so that each controller is synchronized with the other controller and only responds to the commands of the other controller. For example, each controller can transmit its remote ID to the other controller. The remote IDs can be stored in EEPROM, flash memory, etc. of the receiving controller and verified each time a signal is received with a stored remote ID.

From the foregoing disclosure and detailed description of certain preferred embodiments, it will be apparent that various modifications, additions and other alternative embodiments are possible without departing from the true scope and spirit of the invention. The embodiments discussed were chosen and described to provide the best illustration of the principles of the invention and its practical application to thereby enable one of ordinary skill in the art to use the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A wireless damper control device comprising, in combination:

a damper movable between a closed position and an open position;

a damper controller which sends a damper signal which moves the damper between the open position and the closed position; and a fire side controller which transmits a fireplace signal adapted to open a gas valve to initiate combustion when a fire is desired at a fireplace, and adapted to close the gas valve to terminate combustion when a fire is no longer desired at the fireplace, and which receives a damper status signal from the damper controller indicating whether the damper is in the closed position or the open position;

wherein when a fire is desired at the fireplace, the fire side controller transmits a damper control signal to move the damper to the open position, and the fireside controller transmits the fireplace signal to open the gas valve after receiving the damper status signal indicating that the damper is in the open position, and the fire side controller is wirelessly connected to the damper controller.

2. The wireless damper control device of claim 1 further comprising a fireplace and a flue, wherein products of combustion from the fireplace enter the flue.

3. The wireless damper control device of claim 1 further comprising a motor having a rotatable shaft operatively connected to the damper, wherein the damper signal urges the motor to rotate and in turn rotates the rotatable shaft and the damper.

4. The wireless damper control device of claim 1 further comprising a box at least partially surrounding the damper controller.

5. The wireless damper control device of claim 4 wherein the box has a bottom made of plastic.

6. The wireless damper control device of claim 1 wherein the fire side controller transmits a damper control signal to instruct the damper controller to send the damper signal to move the damper to the open position.

7. The wireless damper control device of claim 1 wherein the damper controller comprises a separate antenna circuit board and a damper control circuit board.

8. The wireless damper control device of claim 1 further comprising intermittent transmission of a request for a damper status signal from the fire side controller to the damper controller.

9. The wireless damper control device of claim 8 wherein the request for a damper status signal is sent once every thirty seconds.

10. The wireless damper control device of claim 1 wherein the damper controller and fire side controller form a control circuit, and the control circuit has two sleep modes;

a normal sleep mode; and a power down sleep mode which is entered when no call has been made to transmit the fireplace signal to open the gas valve for a predetermined period of time.

11. The wireless damper control device of claim 10 wherein the predetermined period of time is at least 7 days.

12. The wireless damper control device of claim 1 wherein the fire side controller further comprises a buzzer and a service switch.

13. The wireless damper control device of claim 1 further comprising a battery supplying power to the damper and damper controller.

14. The wireless damper control device of claim 1 further comprising a power source supplying power to the fire side controller, wherein the power source comprises one of a battery, an electrical outlet, and both the battery and the electrical outlet.

15. A wireless damper control device comprising, in combination:

a damper movable between a closed position and an open position;

a damper controller which transmits a damper signal which moves the damper between the open position and the closed position, and the power to move the damper is provided by a battery positioned generally adjacent the damper controller; and a fire side controller which transmits a fireplace signal adapted to open a gas valve to initiate combustion when a fire is desired at a fireplace, and adapted to close the gas valve to terminate combustion when a fire is no longer desired at the fireplace;

wherein when a fire is desired at the fireplace, the fire side controller sends the fireplace signal to open the gas valve after receiving a damper status signal indicating that the damper is in the open position, and the fire side controller is wirelessly connected to the damper controller.

16. A wireless damper control device comprising, in combination:

a damper movable between a closed position and an open position;

a damper controller which sends a damper signal which moves the damper between the open position and the closed position, the damper controller further comprising a transceiver; and a fire side controller having a transceiver which wirelessly transmits a damper control signal received by the damper controller transceiver, and a fireplace signal to open and close a gas valve, and with receives a damper status signal transmitted from the damper controller transceiver indicating whether the damper is in the closed or the open position;

wherein when a fire is desired at the fireplace, the fire side transceiver transmits the damper controller signal and transmits the fireplace signal to open the gas valve after receiving the damper status signal indicating that the damper is in the open position.

17. The wireless damper control device of claim 16 wherein the control circuit comprises one of normal operation, diagnostic mode, hold open mode, ping mode and sleep mode.

18. The wireless damper control device of claim 17 wherein ping mode comprises:

continuously transmitting a ping signal to the damper transceiver for a limited period of time; and producing a first output when no response signal is received and producing a second output when a response is received at the fire side transceiver.

* * * * *